US008555522B2

(12) United States Patent
Bellinger et al.

(10) Patent No.: US 8,555,522 B2
(45) Date of Patent: Oct. 15, 2013

(54) LAUNDRY TREATING APPLIANCE WITH INLET TEMPERATURE COMPENSATION

(75) Inventors: Ryan R. Bellinger, Saint Joseph, MI (US); James P. Carow, Saint Joseph, MI (US); Michele A. Paustian, Kalamazoo, MI (US); David M. Williams, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 428 days.

(21) Appl. No.: 12/909,121

(22) Filed: Oct. 21, 2010

(65) Prior Publication Data

US 2012/0096738 A1 Apr. 26, 2012

(51) Int. Cl.
*F26B 3/00* (2006.01)

(52) U.S. Cl.
USPC ..... 34/549; 34/553; 34/572; 700/299; 340/660; 219/506

(58) Field of Classification Search
USPC ..... 34/549, 553, 572; 700/299; 340/660, 340/310 A, 210 R; 219/492, 506
See application file for complete search history.

(56) References Cited

U.S. PATENT DOCUMENTS 3,428,250 A * 2/1969 Holthausen ..... 236/15 R
3,842,243 A * 10/1974 Gregory ..... 219/497
3,975,832 A 8/1976 Mori et al.
4,019,259 A 4/1977 Veraart
4,195,415 A 4/1980 Livings et al.
4,257,170 A 3/1981 Gestblom et al.
4,397,101 A 8/1983 Rickard
4,520,321 A 5/1985 Nakatsugawa et al.
4,629,852 A * 12/1986 Andre ..... 219/497
4,649,654 A 3/1987 Hikino et al.
4,733,479 A 3/1988 Kaji et al.
4,751,371 A * 6/1988 Clinton ..... 219/506
4,999,730 A 3/1991 Pickard
5,006,778 A 4/1991 Bashark
5,051,996 A 9/1991 Bergeson et al.
5,079,410 A 1/1992 Payne et al.
5,281,956 A 1/1994 Bashark
5,319,514 A 6/1994 Walsh et al.
5,507,055 A 4/1996 Blauert et al.
5,560,124 A 10/1996 Hart et al.
5,623,201 A 4/1997 Park
5,923,676 A 7/1999 Sunter et al.
6,150,792 A 11/2000 Andersson (Continued)

FOREIGN PATENT DOCUMENTS

CN 1928579 A 3/2007
DE 19939274 A1 2/2001

(Continued)

OTHER PUBLICATIONS

German Search Report for DE102011052796, Dec. 21, 2011.

*Primary Examiner* — Steve M Gravini
(74) *Attorney, Agent, or Firm* — Clifton G. Green; McGarry Bair PC

(57) ABSTRACT

A method for operating a laundry treating appliance, such as a clothes dryer, having a treating chamber, an air system for supplying and exiting air from the treating chamber, a heating element for heating the air to the treating chamber, and a controller determining an inlet temperature used as a control input for a cycle of operation.

23 Claims, 5 Drawing Sheets

(56) References Cited

U.S. PATENT DOCUMENTS

| | | | | |
|---|---|---|---|---|
| 6,198,403 | B1 | 3/2001 | Dorrough et al. | |
| 6,271,506 | B1 | 8/2001 | Glaser | |
| 6,397,157 | B1 | 5/2002 | Hogle et al. | |
| 6,457,145 | B1 | 9/2002 | Holmberg et al. | |
| 6,555,796 | B1 * | 4/2003 | Cusack | 219/481 |
| 6,597,144 | B2 | 7/2003 | Pearson et al. | |
| 6,763,485 | B2 | 7/2004 | Whetsel | |
| 6,841,761 | B1 | 1/2005 | Banzato et al. | |
| 7,113,075 | B2 | 9/2006 | Odorcic et al. | |
| 7,282,921 | B2 | 10/2007 | Sela et al. | |
| 7,594,343 | B2 | 9/2009 | Woerdehoff et al. | |
| 2005/0132599 | A1 | 6/2005 | Lee et al. | |
| 2006/0288605 | A1 | 12/2006 | Carow et al. | |
| 2007/0193310 | A1 | 8/2007 | Penteado et al. | |
| 2008/0148597 | A1 | 6/2008 | Kim et al. | |
| 2009/0313848 | A1 | 12/2009 | Moschtz et al. | |
| 2010/0013491 | A1 | 1/2010 | Hooper et al. | |
| 2012/0096738 | A1 * | 4/2012 | Bellinger et al. | 34/493 |

FOREIGN PATENT DOCUMENTS

| | | | |
|---|---|---|---|
| DE | 102006037239 | A1 | 2/2008 |
| DE | 19939271 | A1 | 2/2011 |
| EP | 0060698 | A1 | 9/1982 |
| EP | 0370875 | A1 | 5/1990 |
| EP | 0410827 | A1 | 1/1991 |
| EP | 0648992 | B1 | 4/1995 |
| JP | 52142359 | A | 11/1977 |
| JP | 54116769 | A | 9/1979 |
| JP | 62268599 | A | 11/1987 |
| JP | 2046898 | A | 2/1990 |
| JP | 4197397 | A | 7/1992 |
| JP | 5161793 | A | 6/1993 |
| JP | 6134194 | A | 5/1994 |
| JP | 6134195 | A | 5/1994 |
| JP | 8173698 | A | 7/1996 |
| JP | 2001000793 | A | 1/2001 |
| JP | 2007289494 | A | 11/2007 |
| JP | 2010057669 | A | 3/2010 |
| KR | 20060086089 | A | 7/2006 |
| KR | 0882632 | B1 | 2/2009 |
| KR | 0939716 | B1 | 1/2010 |
| WO | 97/32071 | A1 | 9/1997 |
| WO | 2007/004198 | A1 | 1/2007 |
| WO | 2009/077301 | A1 | 6/2009 |

* cited by examiner

LAUNDRY TREATING APPLIANCE WITH INLET TEMPERATURE COMPENSATION

BACKGROUND OF THE INVENTION

Contemporary laundry treating appliances, such as clothes dryers, may be provided with a treating chamber for receiving a laundry load for treatment, such as drying, and a heating element for heating the air to treat the laundry load. The laundry load may be treated in the treating chamber for a predetermined cycle time according to a cycle of operation.

SUMMARY OF THE INVENTION

A method of operating a clothes dryer by determining a voltage across the heating element and an inlet temperature, wherein the controller determines a compensated inlet temperature based on the inlet temperature and the heater voltage.

DESCRIPTION OF EMBODIMENTS OF THE INVENTION

The invention is generally directed toward accurately estimating an air inlet temperature during a cycle of operation for a laundry load in a laundry treating appliance, such as a clothes dryer, where heated air is used as part of a drying phase of a cycle of operation. The air inlet temperature is one of the primary inputs into known algorithms for estimating cycle time and load mass/size. The air inlet temperature is commonly determined by a thermistor, which may provide an inaccurate temperature value, such as by influence by radiation from a heating element. The radiation effects of the heating element will vary depending on the wattage of the heating element, which is a function of the voltage supplied across the heating element. In this manner, the inlet temperature may be considered a function of the voltage across the heating element. The invention addresses the problem of inaccurate temperature value by compensating the temperature value for such effects. However, compensating for the effects of the radiation from the heating element is not simple because the amount of radiation varies not only with the wattage of the heater, but also as the heating element ages, which leads to a blackening of the heating element that tends to reduce the amount of radiation.

Figure 1:
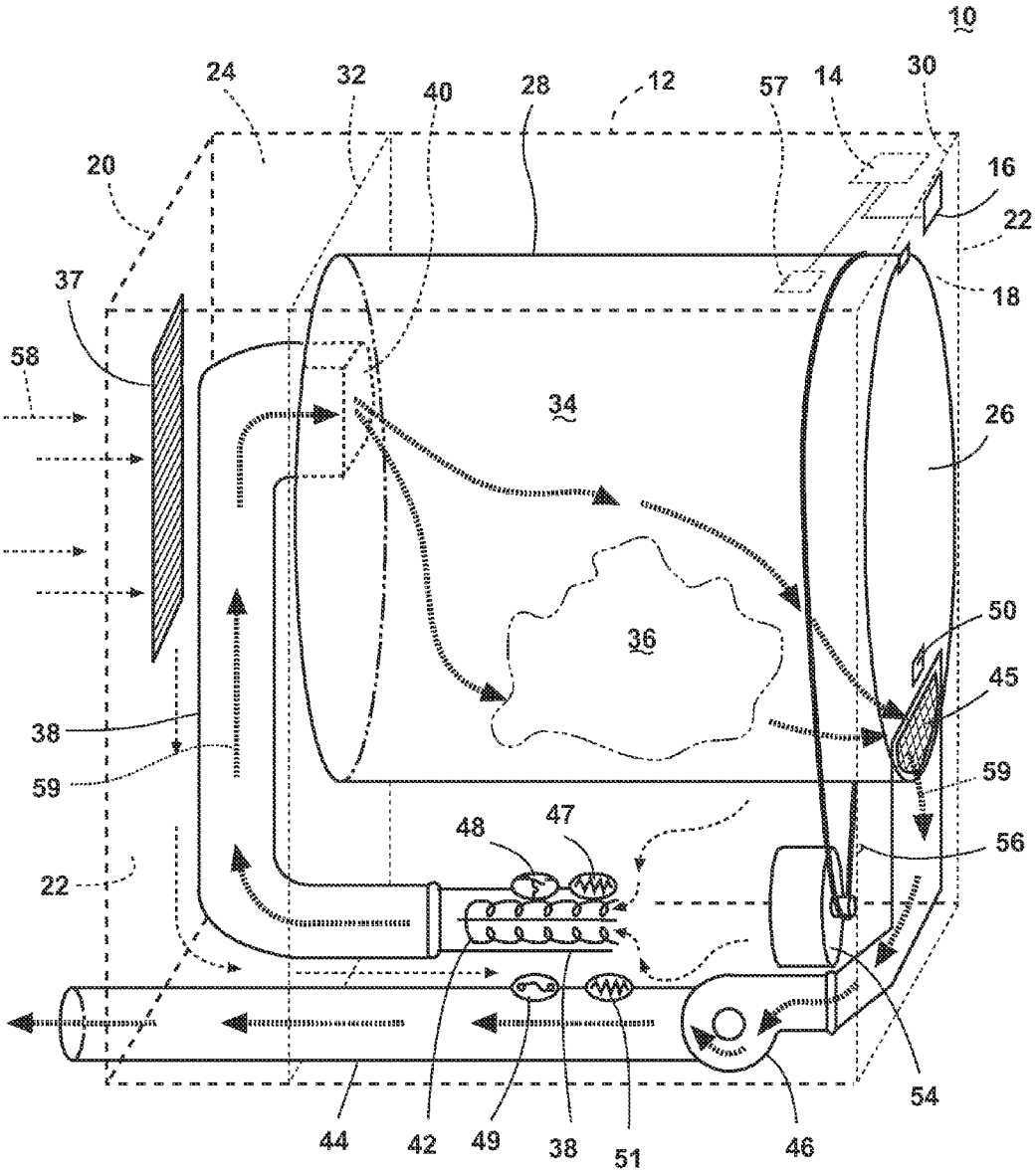
FIG. 1 is a schematic perspective view of a laundry treating appliance in the form of a clothes dryer according to a first embodiment of the invention.

FIG. 1 is a schematic view of a laundry treating appliance 10 in the form of a clothes dryer 10 according to a first embodiment of the invention. While the laundry treating appliance is illustrated as a clothes dryer 10, the laundry treating appliance according to the invention may be any appliance which performs a cycle of operation on laundry and has a drying phase during which air is heated to reduce the moisture in the laundry load, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. The laundry treating appliance according to the invention may also include both an open loop dryer and a closed loop dryer system, for example, a condensing, recirculating, or heat pump dryer. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 which may be defined by a front wall 18, a rear wall 20, and a pair of side walls 22 supporting a top wall 24. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary rear and front bulkheads 30, 32, which collectively define a treating chamber 34, for treating laundry 36, having an open face that may be selectively closed by the door 26. Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter (not shown). In most dryers, there may be multiple lifters. The lifters may be located along the inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a drying cycle. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form in part a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 may be fluidly coupled to the exhaust conduit 44. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct or exhausting the air from the treating chamber 34 to the outside the clothes dryer 10.

The air system may further include various sensor and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining the inlet temperature, that is, the temperature of inlet air. A thermistor 51 and thermal fuse 49 may be coupled to the exhaust conduit 44, with the thermistor 51 being used to determine the outlet air temperature. A moisture sensor 50 may be positioned in the interior of the treating chamber 34 to monitor the amount of moisture of the laundry in the treating chamber 34.

A dispenser 57 may be provided to the clothes dryer 10 to dispense a treating chemistry during a drying cycle. As illustrated, the dispenser 57 may be located in the interior of the cabinet 12 such that the treating chemistry may be dispensed, although other locations are also possible. The dispenser 57 may include a reservoir (not shown) of treating chemistry that is releasably coupled to a dispenser 57, which dispenses the treating chemistry from the reservoir to the treating chamber 34. The treating chemistry may be any type of aid for treating laundry, and non-limiting examples include, but are not limited to fabric softeners, sanitizers, de-wrinklers, and chemicals for imparting desired properties to the laundry, including stain resistance, fragrance (e.g., perfumes), insect repellency, and UV protection.

Figure 2:
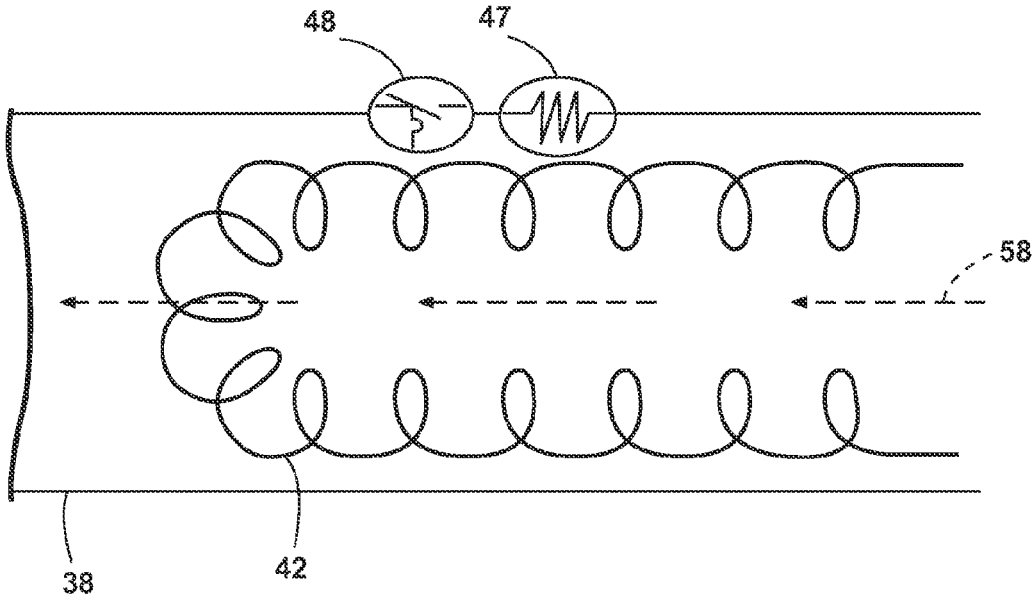
FIG. 2 is a partial schematic view of the supply conduit of FIG. 1, with a thermistor and a thermostat in a physical proximity to a heating element.

FIG. 2 is a partial schematic view of the inlet portion of the supply conduit 38 of FIG. 1, showing the close proximity of the thermistor 47 to the heating element 42, such that the radiation from the heating element 42 will cause the thermistor 47 to inaccurately read the air temperature of the air passing over the heating element 42. The heating element 42 may be configured to fluidly couple to the thermostat 48 and/or the controller 14 (not shown) such that the heating element 42 may be selectively energized or de-energized according to a cycle of operation. Although not illustrated, the heating element 42 may be operably coupled to the electrical mains (L1, L2) to receive voltage input. The thermistor 47 and the thermostat 48 may be separate while the thermistor 47 and the thermostat 48 may be integrated as an assembly.

Figure 3:
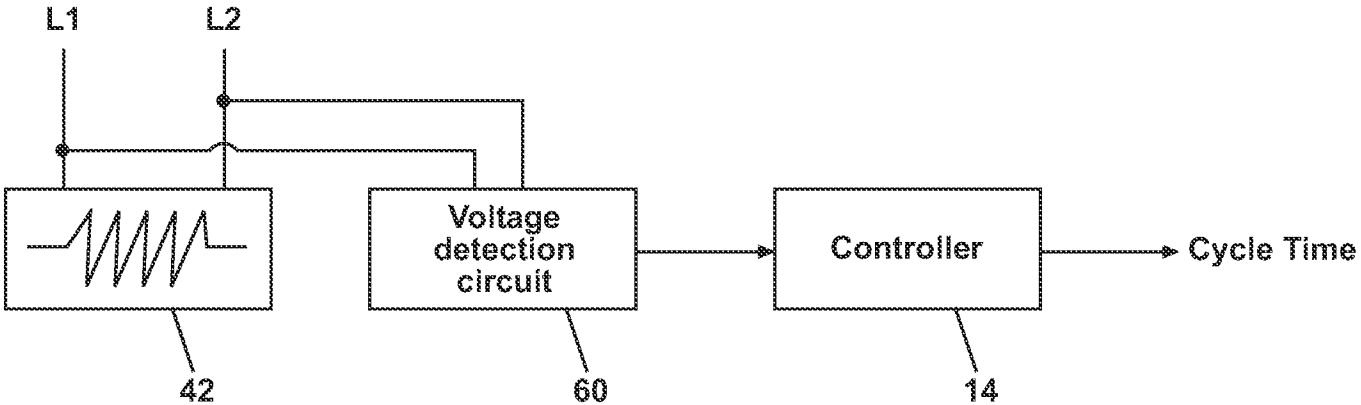
FIG. 3 is a schematic view of a voltage detecting circuit for the clothes dryer of FIG. 1.

FIG. 3 is a schematic view of a voltage detection circuit 60 for the clothes dryer of FIG. 1. The voltage detection circuit 60 may be operably coupled to the heating element 42. The voltage detection circuit 60 may be communicably coupled to the controller 14. As illustrated, the voltage and phase angle across the heating element 42 may be detected by the voltage detection circuit that is coupled to two electrical mains (L1, L2), and may be represented as voltage for L1 to L2.

It is noted that the voltage may be measured by other methods such as a phase angle method. The voltage determined by the voltage detection circuit 60 may be output to the controller 14, in which the determined voltage may be considered in estimating cycle time. In most cases, the output of the voltage detection circuit 60 is a signal indicative of the voltage across the heating element 42, which the controller 14 may use as an indicator of the voltage. Any suitable voltage detection circuit may be used. The particular voltage detection circuit is not germane to the invention.

Figure 4:
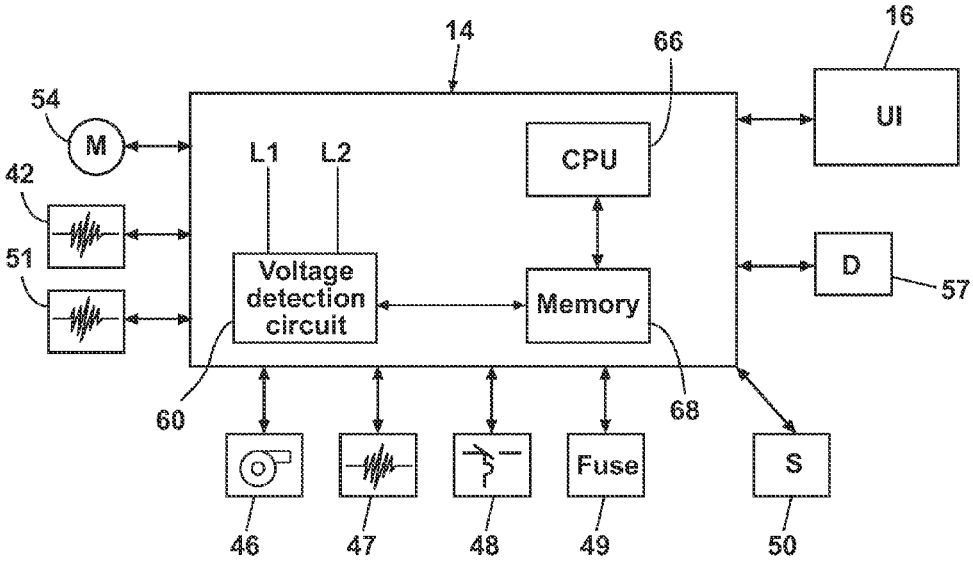
FIG. 4 is a schematic view of a controller of the clothes dryer in FIG. 1.

FIG. 4 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, motor 54, and dispenser 57 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided that has operational controls such as dials, lights, knobs, levers, buttons, switches, and displays enabling the user to input commands to a controller 14 and receive information about a drying cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, Jeans.

The controller 14 may implement a drying cycle selected by the user according to any options selected by the user and provide related information to the user. The controller 14 may also comprise a central processing unit (CPU) 66 and an associated memory 68 where various drying cycles and associated data, such as look-up tables, may be stored. One or more software applications, such as an arrangement of executable commands/instructions may be stored in the memory and executed by the CPU 66 to implement the one or more drying cycles.

In general, the controller will control a drying cycle of operation to cause a drying of the laundry in the treating chamber 34. The controller 14 will actuate the blower 46, which will draw air into the supply conduit 38 through the rear vent 37. The controller 14 may activate the heating element 42 to heat the inlet air flow as it passes over the heating element 42, with the heated air being supplied to the treating chamber 34. The thermistor 47 may sense the temperature of inlet air that passes through the supply conduit 38 and send to the controller 14 a signal indicative of the sensed temperature. The heated air may be in contact with a laundry load 36 as it passes through the treating chamber 34 on its way to the exhaust conduit 44 to effect a moisture removal of the laundry. The air may exit the treating chamber 34, and flow through blower 46 and the exhaust conduit 44 to the outside the clothes dryer 10. The controller 14 continues the cycle of operation until it is determined that the laundry is dry. The determination of a "dry" load may be made in different ways, but is often based on the moisture content of the laundry, which is typically set by the user based on the selected cycle, an option to the selected cycle, or a user-defined preference.

During the drying cycle of operation, it is common for the controller 14 to execute a cycle time calculation to determine the remaining time in the drying cycle. The drying time is then displayed on the user interface 16, typically in terms of minutes, which are then counted down until the next, if any determination. It is also known for the controller 14 to execute a load mass estimate (LME) calculation to estimate the mass, could also be amount or weight, of the clothes load in the treating chamber 34. The LME is often executed as part of a treating chemistry phase or a steam treating phase, where the change in mass can be used to determine how much treating chemistry or steam was absorbed by the laundry, respectively. This change in mass may be used in many ways, as relevant to this disclosure it may be used as an input to the drying time calculation, which is part of the cycle time estimation, as it is indicative of the moisture absorbed by the laundry that must be evaporated.

Figure 5:
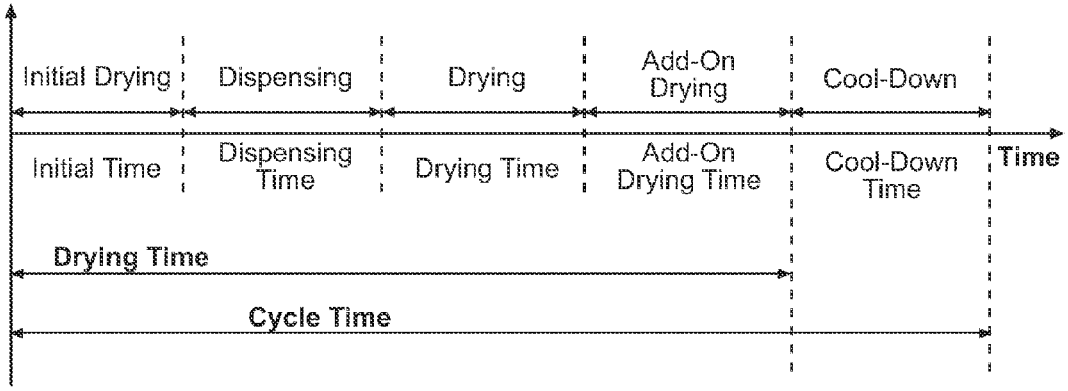
FIG. 5 is a schematic view of a timeline for a drying cycle of operation.

A brief review of the cycle time estimation and the LME will be useful in understanding the importance of accurately determining the inlet temperature. Referring to FIG. 5, the overall cycle time of a cycle of operation, such as a drying cycle of operation, may comprise many subparts, each of which has their time, with all of them collectively forming the cycle time. FIG. 5 is a schematic view of a timeline for a drying cycle of operation, which may be have subparts or sub-cycles, such as an Initial Drying, Dispensing, Drying, Add-On Drying, and Cool-Down. Each of these phases has a corresponding time, which may or may not be variable as the case may be. The total of these times will be referred to as the Cycle Time in this application, with it being understood that the Cycle Time is a function of the time of these phases. Not all of the phases are related to the drying of the laundry. The sum of the phases related to the drying of the laundry will be referred to as the Drying Time.

The Initial Drying phase is normally a predetermined time period, Initial Time, of about five minutes in length. During this time, the moisture sensor 50 has not provided sufficient moisture data for the controller 14 to make an initial estimate of how wet is the laundry. Thus, an initial Cycle Time is selected based on the selected cycle, load size, and sometimes other data. This data is normally taken from a look up table in the memory 68 of the controller 14. This initial Cycle Time is displayed on the user interface 16 and is counted down as time passes.

After the Initial Drying phase is completed, a Drying phase is begun for a Drying Time and the controller 14 may use the moisture data during the Initial Drying phase to determine the Drying Time and update the estimate of the Cycle Time. The updated Cycle Time will necessarily take into account the time that has already lapsed. Thus, the updated Cycle Time may be thought of as a remaining cycle time. The updated Cycle Time is then displayed on the user interface 16. The LME may be calculated in the Drying phase and used as an input to the Cycle Time calculation. The Cycle Time may be updated any number of times, but it is normally updated only one more time, which coincides with the time at which the moisture sensor 50 no longer can provide useful data, which is about 10% to 15% moisture content for most contemporary conductivity moisture sensors.

The Add-On Drying phase begins at the point where the moisture sensor 50 no longer provides useful data. At this time, the controller 14 will determine how much time is needed to dry the laundry, Add-On Drying Time, if any. If no more time is needed, the Cool-Down phase is begun. The Add-On Drying Time is normally based on the moisture data, inlet temperature data, and outlet temperature data during the Drying phase. If a new Cycle Time is warranted, then the Cycle Time will be updated and displayed.

Once the Add-On Drying phase is completed, the Cool-Down phase is executed until the end of the Cycle Time. If need be, the Cycle Time may be updated. The Cool-Down time may be determined in a preselected manner, for example, by using a "look-up table" or an array of cool down times stored in the controller 14 and based upon selected fabric type, dryness, load size, and the like, or by calculating the Cool-Down time based on a total calculated dry time and a preselected heater set temperature.

The Initial Time, Dispensing Time, Drying Time, and Add-On Drying Time are sometimes referred to as the drying time because their sum represents the time that the laundry is being dried, which normally coincides with the air being heated. The cumulative time of all five phases represents the Cycle Time. For purposes of this application, the term Cycle Time is meant to refer to the total time it takes for the cycle of operation to complete, regardless of whether the drying cycle of operation has all four of these phases. The term drying time is meant to refer to the time that the laundry is being dried or relevant drying sub phases, such as the Drying Time, with or without the Initial Time or the Add-On Drying Time.

Determining a cycle time in the clothes dryer 10 is fully set forth in detail in U.S. Pat. No. 7,594,343, issued Sep. 29, 2009, and titled "Drying Mode for Automatic Clothes Dryer", which are incorporated herein by reference in its entirety.

The LME is a calculation based on the thermodynamics of the dryer system and uses the inlet temperature, which is a function of the air flow, and the outlet temperature, which is a function of the airflow and the thermal capacity of the intervening laundry. Practically speaking, all things being equal, the inlet temperature and the outlet temperature would essentially be the same absent the impact of the intervening load on the air flow. Thus, the change in the inlet air temperature and the outlet air temperature is indicative of the mass of the intervening laundry.

In a specific implementation, the inlet air temperature, exhaust air temperature, an operational status of the heating element 42, and the voltage detection circuit 60 are inputs for calculating the LME. These inputs are input to one or more algorithms stored in the controller 14 to estimate LME. The calculation of LME of the laundry may allow at least one of a qualitative and quantitative load size, where qualitative load size may include at least one of a small, medium, and large load. The LME may further provide an estimation of at least one of the water and treating chemistry coupled to the laundry, and may be directly related with the cycle time. For example, higher LME may suggest longer cycle time.

Any error in the inlet temperature sensed by the inlet air temperature thermistor 47 will necessarily result in an inaccurate determination of the drying time and the LME. It has been determined that the radiant heat from the heating element 42 is one of, if not the primary source of, inaccuracies in the temperature output readings by the inlet air temperature thermistor 47. Moving the thermistor 47 further away from the heating element 42 would reduce the amount of inaccuracy, but would not eliminate the inaccuracy. Thus, to obtain an accurate inlet air temperature reading from the thermistor, it is still necessary to compensate for inaccuracies attributable to the radiation from the electric heating element 42.

If the heat radiation from the heating element 42 were constant over time, it would be possible to create a correction factor the thermistor 47. Unfortunately, the radiation is not constant and is found to be a function of the thermal output (wattage), the blackening of the heating element over time. The blackening of the heating element happens in a known manner and can be accounted for by a suitable use-based correction factor. However, the thermal output of the heating element is inconsistent for a variety of reasons, such as incorrect wiring and/or fluctuations in the voltage supplied to the heating element. Fortunately, it is found that all things being equal, the radiation of the electric heating element is a function of the thermal output (wattage) of the heating element. Thus, determining the actual voltage supplied to the heating element provides for an accurate indication of the corresponding radiation, which can then be used to compensate the temperature value from the thermistor 47 to improve the accuracy of the inlet temperature value, which leads to improved accuracy in the drying time, cycle time, and LME.

To compensate the inlet air temperature as sensed by the thermistor 47, output from the voltage detection circuit 60 may be used to determine the actual voltage of the heating element 42. The actual voltage may then be used to determine the corresponding thermal output (wattage) of the heating element 42 and a corresponding correction factor. This data may be provided as a data table in the memory of the controller 14.

In reality, it will likely be unnecessary to literally calculate/determine the actual voltage or wattage. In most cases, the output from the voltage detection circuit 60 will be an electrical signal having a characteristic, such as magnitude of the signal voltage, which is proportional to the voltage across the heating element 42. As the voltage across the heating element 42 has a known relationship to the actual wattage of the heating element 42, the characteristic of the signal from the voltage detection circuit 60 will be directly indicative of the wattage of the heating element 42. Thus, the tabular data may be that of various values of the characteristic of the signal from the voltage detection circuit 60 and the corresponding correction factor for the associated wattage.

Determining the compensated inlet temperature may be implemented based on various parameters including the voltage/wattage actually measured across the heating element 42 during a cycle of operation, inlet temperature, exhaust temperature which is a temperature of the air flow exiting the treating chamber 34, air flow characteristics in the supply conduit 38, thermal flow characteristic from the heating element 42 to the thermistor. Once the compensated inlet temperature is determined as described, the controller 14 may use the compensated inlet air temperature to update the cycle time for a cycle of operation and the LME.

Figure 6:
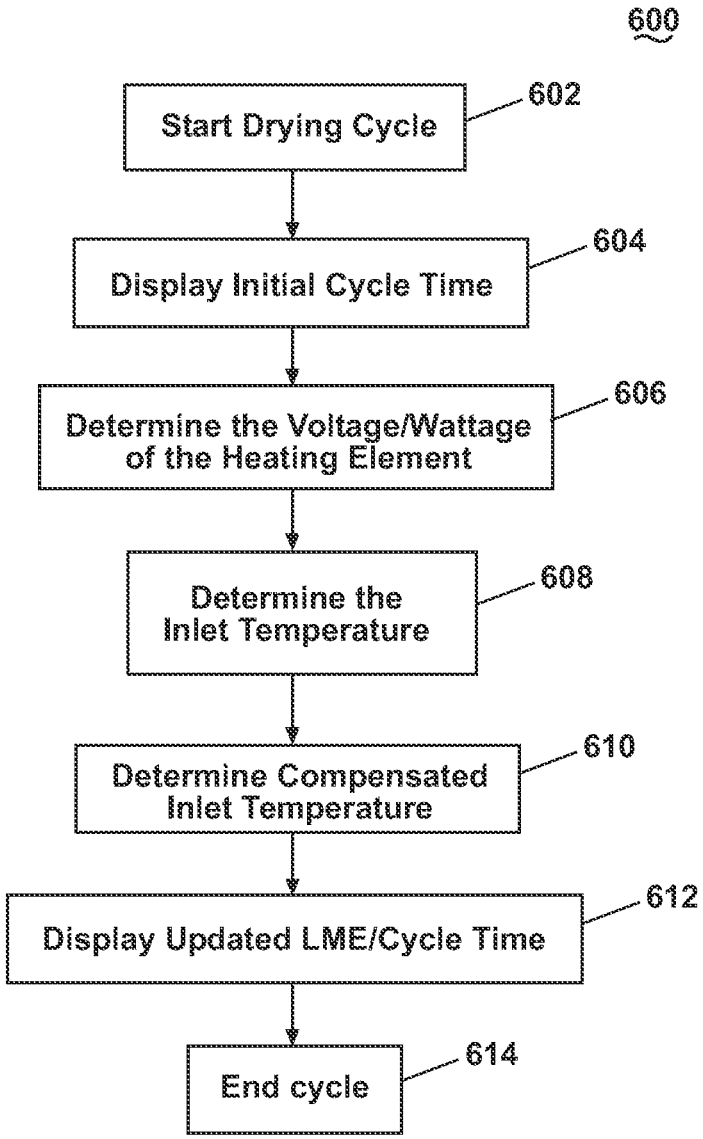
FIG. 6 is a flow chart for operating the clothes dryer according to a second embodiment of the invention.

FIG. 6 is a flow chart for operating the clothes dryer 10 according to a second embodiment of the invention. The sequence of steps depicted in FIG. 6 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the clothes dryer 10, such as prior to or as part of any phase of the treatment cycle. The method may also be a stand-alone cycle.

The method 600 may begin at 602 by starting a drying cycle. It is assumed that the drying cycle may be implemented with laundry inside the treating chamber 34. At 604, initial cycle time estimate may be displayed on the user interface 16 to notify the user of the cycle time, such as a remaining cycle time. The initial cycle time at 604 may be estimated using fuzzy logic or regression analysis methods based on initial inputs such as load size, load fabric type, and initial wetness, or, alternatively, a table look up may be used.

At 606, a wattage output determination of the heating element 42 may be made as previously described. The wattage determining step at 606 may be configured to implement at any time or multiple times during the cycle. It is advantageous for 606 to be implemented after passage of a predetermined time once a drying cycle begins. The wattage output may be sent to the controller 14 to calculate updated cycle time. At 608, the inlet temperature of the inlet air may be determined using the thermistor, and the output reading may be sent to the controller 14. It is noted that 606 and 608 may be implemented consecutively while 606 and 608 may occur at the same time. At 610, the compensated inlet temperature may be determined in the controller 14 as described. The compensated inlet temperature may be used in calculating LME and cycle time.

At 612, the updated LME or updated cycle time may be displayed on the user interface 16 to provide the user with the updated remaining cycle time. In updating the LME or cycle time of a cycle of operation, additional inputs may be needed such as an exhaust temperature such that the output signal for exhaust temperature may be sent to the controller 14 to provide a value indicative of the exhaust temperature.

At 614, the cycle may complete after the updated cycle time is displayed. Typically the cycle time may be updated once during a cycle of operation assuming that the voltage/wattage across the heating element 42 may be consistent and may not vary more than a predetermined range during a whole drying cycle while the cycle time may be updated more than one time. Under this condition, the method 600 may go back to 606 through 612 to 614 until it is determined that the cycle completes.

Alternatively, the cycle may complete or the heating element 42 may not be energized anymore during a cycle of operation, when the comparison of the exhaust temperature and the compensated inlet temperature satisfies the criterion for a desired dryness. The comparison step may be implemented in the controller 14.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a clothes dryer having a treating chamber, an air system having a supply conduit to supply air to and an exhaust conduit to exhaust air from the treating chamber, a heating element for heating the air supplied to the treating chamber, and a controller controlling the operation of the air system and the heating element to effect a drying of laundry in the treating chamber as part of implementing a cycle of operation, the method comprising:

sensing a voltage applied to the heating element;

providing the voltage as input to the controller;

sensing a temperature of the supply air in the supply conduit to define an inlet temperature; and providing the inlet temperature to the controller;

wherein the controller determines a compensated inlet temperature based on the inlet temperature and the heater voltage and alters the cycle of operation effecting a drying of the laundry in the treating chamber based on the compensated inlet temperature.

2. The method of claim 1 further comprising adjusting the implementing of the cycle of operation based on the compensated inlet temperature.

3. The method of claim 2 wherein the adjusting the implementing of the cycle of operation comprises setting a cycle time.

4. The method of claim 3 wherein setting the cycle time comprises setting a remaining cycle time.

5. The method of claim 4 further comprising repeatedly setting the remaining cycle time during the implementation of the cycle of operation.

6. The method of claim 5 wherein the repeatedly setting the remaining cycle time comprises repeatedly sensing the voltage and repeatedly determining the compensated inlet temperature for each repeated setting of the remaining cycle time.

7. The method of claim 3 wherein setting a cycle time comprises setting a drying time portion of the cycle time.

8. The method of claim 1 further comprising the controller determining an air flow condition based on the compensated inlet temperature.

9. The method of claim 8 wherein the air flow condition comprises at least one of a blockage of the air system and a leakage of the air system.

10. The method of claim 9 wherein the heating element comprises a first and second heating element and the air flow condition further comprises at least one of shutting off at least one of the heating elements and terminating the cycle of operation in response to a blockage of the air system.

11. The method of claim 1 wherein the sensing a voltage applied to the heating element comprises sensing the voltage between electrical mains supplying electricity to the heating element.

12. The method of claim 1 wherein the providing the voltage as input to the controller comprises providing a value indicative of the voltage to the controller.

13. The method of claim 9 wherein the providing a value indicative of the voltage to the controller comprises providing a signal to the controller.

14. The method of claim 1 wherein the providing the inlet temperature as input to the controller comprises providing a value indicative of the inlet temperature to the controller.

15. The method of claim 14 wherein the providing a value indicative of the inlet temperature to the controller comprises providing a signal to the controller.

16. The method of claim 1 further comprising sensing a temperature of the exhaust air to define an exhaust temperature and providing the exhaust temperature to the controller.

17. The method of claim 16 wherein the providing the exhaust temperature to the controller comprises providing a value indicative of the exhaust temperature.

18. The method of claim 16 wherein the controller determines an estimate of a load size of the laundry within the treating chamber from the compensated inlet temperature and the exhaust temperature.

19. The method of claim 18 wherein the load size comprises at least one of a qualitative and quantitative load size.

20. The method of claim 19 wherein the qualitative load size comprises at least one of a small, medium, and large load.

21. The method of claim 16 further comprising terminating at least one of an actuation of the heating element and the cycle of operation when a comparison of the exhaust temperature and the compensated inlet temperature is indicative of a desired dryness.

22. The method of claim 21 wherein the desired dryness is input to the controller by a user.

23. The method of claim 21 wherein the comparison of the exhaust temperature and the compensated inlet temperature comprises determining a difference between the exhaust temperature and the compensated inlet temperature.

* * * * *